US007819065B2

(12) United States Patent
Haeselich

(10) Patent No.: US 7,819,065 B2
(45) Date of Patent: Oct. 26, 2010

(54) CARTRIDGE PRACTICE ROUND

(75) Inventor: Detlef Haeselich, Muessen (DE)

(73) Assignee: Nico-Pyrotechnik Hanns-Juergen Diergen Diederichs & Co., KG, Trittau (DE)

( * ) Notice: Subject to any disclaimer, the term of this patent is extended or adjusted under 35 U.S.C. 154(b) by 1455 days.

(21) Appl. No.: 10/897,927

(22) Filed: Jul. 23, 2004

(65) Prior Publication Data

US 2006/0032393 A1 Feb. 16, 2006

(30) Foreign Application Priority Data

Apr. 8, 2004 (DE) ..... 10 2004 017 464

(51) Int. Cl.
*F42B 8/00* (2006.01)

(52) U.S. Cl. ..... 102/444; 102/439; 102/502; 102/513; 102/529

(58) Field of Classification Search ..... 102/501, 102/502, 439, 444, 498, 513, 517, 529
See application file for complete search history.

(56) References Cited

U.S. PATENT DOCUMENTS 4,208,968 A * 6/1980 Hubsch et al. ..... 102/513
6,041,712 A * 3/2000 Lyon ..... 102/439
6,845,716 B2 * 1/2005 Husseini et al. ..... 102/466
6,990,905 B1 * 1/2006 Manole et al. ..... 102/513
7,204,191 B2 * 4/2007 Wiley et al. ..... 102/517

* cited by examiner

*Primary Examiner*—James S Bergin
(74) *Attorney, Agent, or Firm*—Karl F. Milde, Jr.; Eckert Seamans Cherin & Mellott, LLC

(57) ABSTRACT

The cartridge-type training round consists of a projectile and a cartridge shell into which the projectile is inserted. The projectile includes a one-piece cylindrical central body (2) and a one-piece basin-shaped projectile tip (5) that is pressed onto the central body and engages a circumferential engagement bead (7) with a circumferential engagement slot (8) located in the central body (2). The cartridge shell (20) is a one-piece basin-shaped part; it is also pressed onto the central body (2) and engages a circumferential engagement bead (22) with a circumferential engagement slot (23) of the central body (2). A receiver recess (25) is provided in an approximately cylindrical projection (24) that is inserted centered from the base to receive the propulsive charge (28) and its igniter (29). The round is of simple design, and may be manufactured inexpensively owing to its simple parts that may be largely of plastic without loss of function.

8 Claims, 2 Drawing Sheets

CARTRIDGE PRACTICE ROUND

BACKGROUND OF THE INVENTION

The invention relates to a cartridge consisting of a projectile and a cartridge shell surrounding this projectile, whereby the cartridge consisting of projectile and cartridge shell is suitable for use in a long-barreled weapon, especially one of medium caliber, e.g., 40 mm. The projectile includes a projectile body with a projectile tip and a projectile base; a charge chamber containing a propulsion charge is provided within the cartridge shell that may be ignited via a pyrotechnic igniter.

The projectile and the cartridge shell are joined mechanically—e.g., threaded, crimped, etc., whereby this connection may also be designed as an intentional break point.

After the propulsive charge is ignited, it burns rapidly, whereby the propulsive gases so developed create high pressure within the propulsion chamber that acts on the base of the projectile; the mechanical connection between cartridge shell and projectile breaks at a pre-determined pressure so that the projectile is driven out of the cartridge shell.

This and other known practice cartridges have a relatively expensive design with rotating parts, machine-drilled bores, rifling, etc. So, for example, cartridge shells and projectile bodies are connected via a central threaded shell on the cartridge shell and a corresponding thread in the projectile base, whereby this threaded connection simultaneously forms an intentional break point. Further, the propulsion chamber is a machined or cast metal part that is threaded into the base of the cartridge shell, and is also further connected via a threaded insert in the base of the cartridge shell. Manufacturing costs may be held down since such practice cartridges may be produced in large quantities.

SUMMARY OF THE INVENTION

The invention is based on the object of providing a design for a cartridge practice round of the type described above, by means of which the manufacture of rounds is greatly simplified.

A further object of the invention is to provide a design for a cartridge practice round of the type described above, by means of which the manufacturing cost for the rounds is reduced.

It is a further object of the present invention to so configure the design of the cartridge practice round that the firing characteristics and ballistic characteristics of the round during flight are not inferior to the state of the art versions that are more expensive.

Finally, it is the object of this invention to so simplify the design of the cartridge round that fewer parts are used for the projectile and the cartridge shell.

The projectile for the cartridge practice round according to the invention includes a cylindrical central body with two faces whereby the first, lower face forms the base of the projectile. Further, a one-piece projectile tip is provided in the shape of, for example, a hood that becomes a spring collar on its lower end facing the central body. The lower, open end of this spring collar is provided with an inner circumferential engagement element. The collar of the projectile tip is pressed onto the side opposite the projectile base onto the circumference of the central body whereby the first engagement element of the tip collar fits into a corresponding second engagement element of the central body, locking the central body to the projectile tip.

The cartridge shell is of one piece, and is shaped approximately as a cylindrical basin whose upper, open end side wall facing the central body transforms in its upper area into spring-elastic collar that is provided at the upper edge with a first engagement element facing inwards. The cartridge shell is pressed onto the central body, whereby the engagement element of the cartridge shell engages with a corresponding second engagement element on the central body so that the central body and the cartridge shell are locked together.

This locking forms the mechanical connection between projectile and cartridge shell.

The above-mentioned first engagement elements on the collar are preferably edge beads; the second engagement elements in the central body are preferably matching slots.

The cartridge shell includes another approximately cylindrical central projection with a central opening on its base facing inwards, into which a housing may be inserted, and into which housing the propulsive charge and the pyrotechnical igniter for the charge fit.

The propulsion chamber to propel the projectile is thus the space between the base of the central body and the space between the sidewall of the cartridge shell and the walls of the central projection.

The base body of the cartridge round thus consists of only three parts, namely the central body, the one-piece projectile tip, and the one-piece cartridge shell. Cartridge shell and projectile tip are preferably plastic parts, and are either swedged (deep down) or injection-molded, making manufacture simple and inexpensive.

The central body may be of plastic material, whereby such plastic material should have a high specific weight in order to maintain the position of the center of mass and the aerodynamic pressure points similarly to that of a live round, and to give the practice projectile good ballistic characteristics of a live round. Composite materials of metal (preferably bronze that may be worked as easily as plastic) and plastic are also well suited for this. Other materials such as aluminum, etc., are possible. The central body may be a full or a hollow cylinder.

Dye powder, for example, may be contained in the projectile tip that bursts as the projectile strikes the target, releasing the dye and marking the strike point. Also, bursting containers may be positioned within the projectile tip alone or additionally to the dye powder. These bursting containers may contain chemical reagents in two compartments that mix together when the containers burst, and create light using chemoluminescence so that the strike point of the projectile on the target is visible at night.

The central body may include a surrounding projection along the circumferential direction that is positioned between the engagement slots into which the engagement bead of the hood and the cartridge:shell fit; this projection serves as a guide or twist band when the practice projectile is fired from a weapon with a drawn barrel.

The spring-elastic collar of the cartridge shell is preferably so shaped that it does not rest directly on the barrel of the weapon, at least in its upper region, but rather is at a small distance from it. When the propulsive gases from the propulsive charge act on the base of the projectile, the collar is pressed outward against the barrel beginning at a specific pressure without releasing the projectile. This has the advantage that, when the propulsive gases burn, they do not leak out backward between the collar of the cartridge shell and the barrel, thus allowing no loss of gas in this direction. If the pressure in the chamber continues to rise, then the engagement bead of the cartridge shell is sheared off from the engagement slot of the projectile at a specific pressure, whereby the connection between engagement bead and surrounding slot is broken and the projectile is released from, and is driven from, the cartridge shell.

Release of the projectile results at an easily-reproducible pressure so that the same release and ballistics characteristics are achieved for the projectile.

In spite of the simple design of this practice round, it possesses the same characteristics of a much more expensive round.

For a full understanding of the present invention, reference should now be made to the following detailed description of the preferred embodiments of the invention as illustrated in the accompanying drawings.

BRIEF DESCRIPTION OF THE FIGURES DRAWINGS

Figure 1:
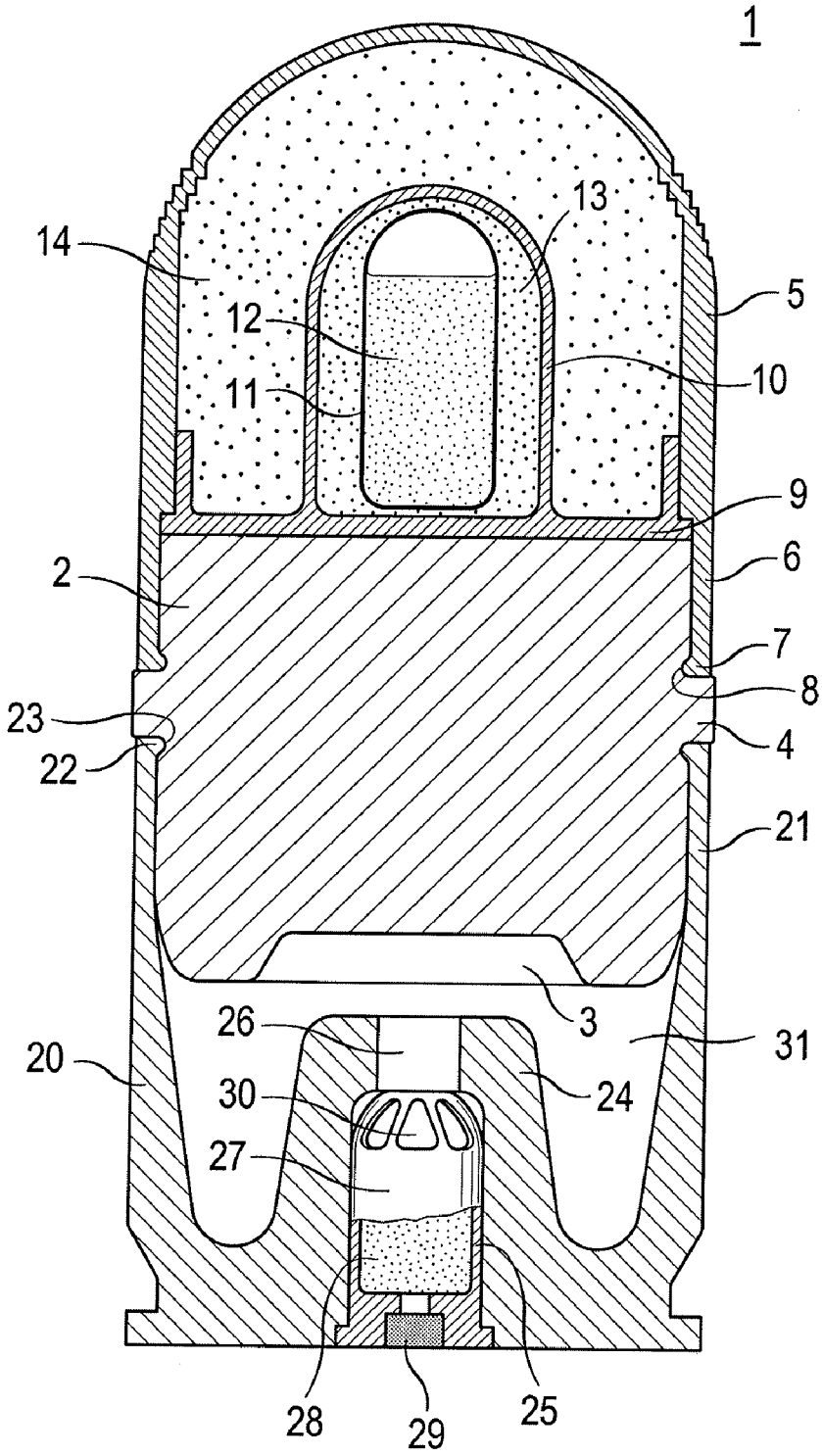
FIG. 1 is a longitudinal cross-section through a cartridge practice round consisting of a projectile and a cartridge shell.

A cartridge practice round 1 includes a central body 2 that is shaped as a filled cylinder consisting of heavy plastic, particularly one reinforced with bronze, with a high specific weight. The central body is shaped as a filled cylinder, and possesses two faces whereby the lower face in the FIG. 1 is equipped with a central, relatively wide cylindrical recess 3 but the upper face is flat. A surrounding projection 4 is located approximately in the center of the central body 2 that possesses the function of a guide or twist band.

A projectile tip 5 is positioned on the central body 2 that is preferably a one-piece deep-drawn plastic part with the shape of a thin-walled hollow cylinder that transforms into a spherical cap with almost hemispherical shape. The projectile tip 5 transforms into a spring-elastic collar 6 at its lower end facing the central body 2 whose lower end includes a surrounding engagement bead 7 that, when one presses the projectile tip 5 onto the circumference in the upper part of the central body 2, engages into a surrounding engagement slot 8 of the central body, whereby this engagement slot is provided, for example, directly on the upper edge of the guide band 4.

DETAILED DESCRIPTION OF THE PREFERRED EMBODIMENT

Figure 2:
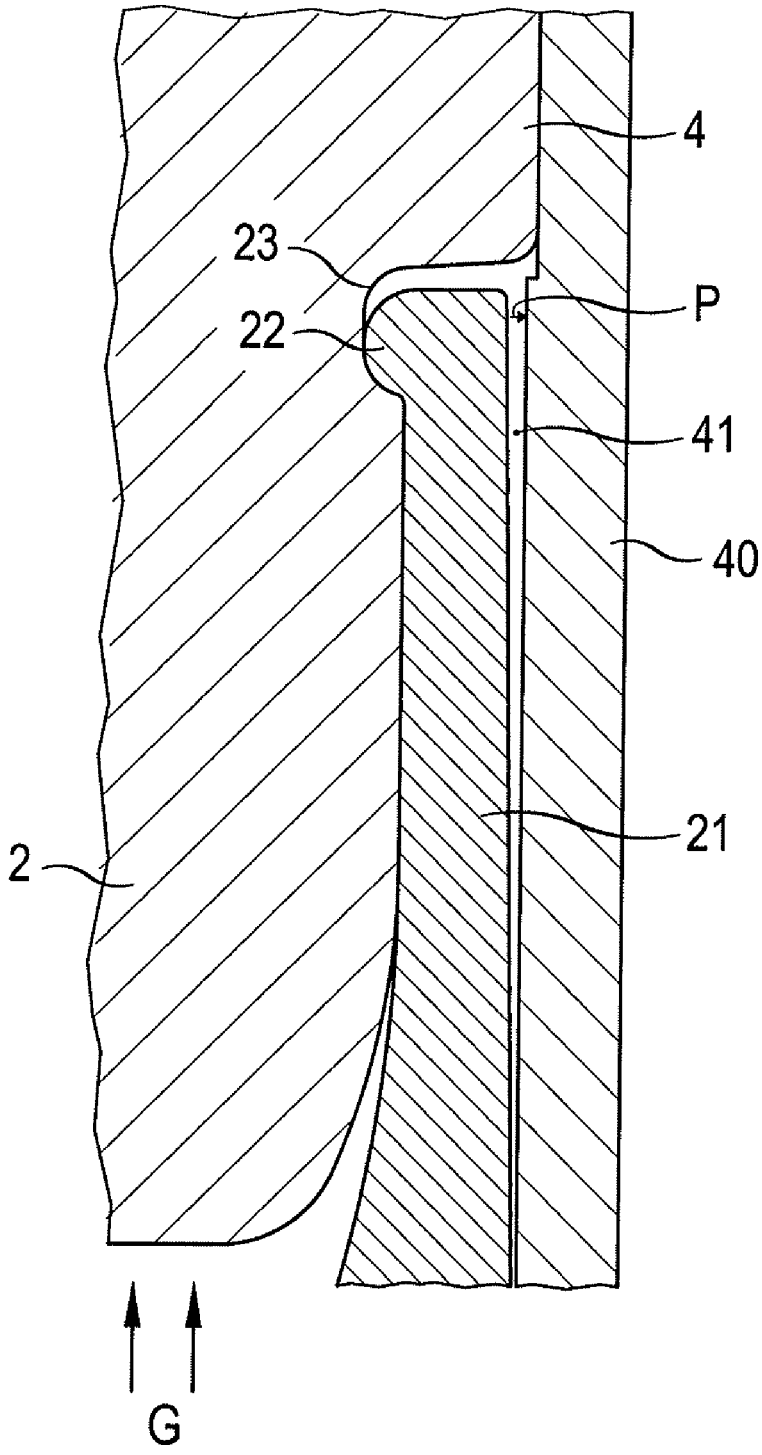
FIG. 2 is a longitudinal cross-section through a detail in the area of the connection between cartridge shell and projectile.

The preferred embodiments of the present invention will now be described with reference to FIGS. 1 and 2 of the drawings. Identical elements in the various figures are designated with the same reference numerals.

The space between the upper face of the central body and the hood is filled with a carrier plate 9 resting against the upper face that includes a central container 10 within which an inner container 11 is provided. Materials 12 and 13 are placed into the inner container, and the space between the inner container 11 and outer container 10, respectively, whereby the two materials react with chemoluminescence when combined together when the containers burst, thus creating light.

The remaining space between the carrier plate 9, the container 10, and the projectile tip is filled with a marking material 14, e.g., a red powder dye.

The carrier plate 9 and the container 10 or 11 may also be of plastic.

The described projectile is inserted into a cartridge shell 20 that consists preferably also of plastic and an injection-molded part. The cartridge shell 20 is shaped like a basin, whereby the wall thickness at the open end of the basin is reduced to the point that it forms a spring-elastic collar 21. The upper end of the spring-elastic collar 21, like the projectile tip 5, includes a circumferential engagement bead 22 that, when one presses the cartridge shell with its collar 21 over the lower end of the central body 2, snaps into a circumferential slot 23 of the central body 2. The circumferential slot 23 is positioned directly below the guide band 4.

The cartridge shell 20 includes an approximately cylindrical central projection 24 from its base that includes a central, essentially cylindrical receiver space 25 projecting from the base that penetrates the upper wall of the projection 24 to which an exhaust opening 26, narrowed with respect to the receiver space 25, is connected that ends barely under the end of the recess 3 on the base of the central body 2.

A matching housing 27 in which a pyrotechnic propulsive charge 28 and a pyrotechnic igniter cap 29 are provided may be pressed into the receiver space 25 and attached there. The housing 27 includes apertures 30 on its end facing the exhaust opening 26 that communicates directly with the exhaust opening.

The illustrated cartridge practice round is manufactured as follows:

The projectile tip 5 rests on a carrier with its hollowed cavity so that the open end with the collar 6 is pointing upward. The dye powder 14 is placed into the projectile tip and the plate 9 is inserted with its container 10 attached (or made of one piece) into the projectile tip, where it rests against a flange. Subsequently, the projectile tip 5 thus prepared is placed on the central body 2, and is locked by means of the engagement bead 7 and the engagement slot 8.

Next, the housing 27 with the propulsive charge 28 and the igniter cap 29 are inserted into the receiver space 25 of the cartridge shell 20 and properly secured, e.g., using a locking mechanism, adhesive, etc. The cartridge shell 20 with its elastic collar 21 is then pressed from below onto the central body 2 until the engagement bead 22 engages with the engagement slot 23.

Manufacture of the cartridge practice round is thus complete.

The cartridge 1 may now be loaded into a long-barreled weapon and the projectile may be fired. The condition at the moment of firing is shown in FIG. 2 at the area of the connection between the cartridge shell 20 or its collar 21 and a barrel 40 (indicated). In unloaded condition, i.e., before firing, a small split is provided between the outer wall of the collar 21 and the inner wall of the barrel 40 that slightly increases toward the upper end of the collar 21.

If the propulsive charge 28 is ignited using the igniter cap 29, then the propulsive gases from the propulsive charge 28 stream through the apertures 30 and the exhaust aperture 26 into the propulsion chamber and act on the base of the central body 2 and the recess 3 in its lower face. As the pressure continues to increase, propulsive gases also enter the space between the central body 2 and the collar 21 and bend the collar (as shown by the small arrow P) toward the inner wall of the barrel 40 until the collar is fully seated against this inner wall. If the pressure continues to rise, the surrounding engagement bead 22 is sheared off, whereby the projectile is released and driven from the barrel. An advantage here is the fact that no gas can leak backward between the collar 21 and the inner wall of the barrel 40 during firing since the collar 21 is pressed against the inner wall of the barrel 40 during the entire propulsion process. There is thus no gas loss backward toward the base of the cartridge shell.

Moreover, it has been shown that the shearing force between the surrounding engagement bead 22 and the surrounding engagement slot 23 may be reproduced very accurately so that the projectiles are propelled from the cartridge shell at the same pressure for every shot, providing easily-reproducible shot patterns.

There has thus been shown and described a novel cartridge practice round which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Practice cartridge round, comprising projectile including a projectile body and a projectile tip, and a cartridge shell into which the projectile is inserted, and that possesses a propulsion chamber, a pyrotechnic propulsive charge, and a pyrotechnic igniter for the propulsive charge, whereby the round may be used in a long-barrel weapon, and whereby the projectile is propelled out of the cartridge shell upon ignition of the propulsive charge by means of pressure buildup within the propulsion chamber, the improvement comprising (a) a one-piece cylindrical central body; (b) a one-piece basin-shaped projectile tip having a spring-elastic collar with a first engagement element surrounding its outer edge and facing inward so that, when the projectile tip is pressed onto the central body, the first engagement element engages a circumferential engagement bead with a first circumferential engagement slot located in the central body; and (c) a cartridge shell formed as a one-piece basin-shaped part whose open end transforms into a collar that includes a second surrounding engagement element at its open end that engages with a second circumferential engagement slot of the central body, said cartridge shell having a base and an approximately cylindrical projection directed inward from the base, in which a receiver recess is provided for the propulsive charge and for an igniter device, wherein the collar of the cartridge shell tapers smoothly inward along a direction from the second engagement slot of the central body toward the base of the cartridge shell, and wherein, in the area of this engagement slot, outer diameter of the collar is less than, and remains within the outer diameter of the central body, whereby the cartridge shell includes an exhaust aperture that ends beneath the base of the central body and whereby, during ignition and firing, gases forced into the space between the central body and collar cause the collar to expand and fully seat against an inner wall of a surrounding barrel of the weapon.

2. Practice cartridge round as in claim 1, wherein the one-piece projectile tip and the one-piece cartridge shell are each made of plastic material.

3. Practice cartridge round as in claim 1, wherein the central body is made of a plastic-composite material.

4. Practice cartridge round as in claim 3, wherein the composite material is a mixture of plastic and bronze.

5. Practice cartridge round as in claim 1, wherein the central body includes a circumferential projection that serves as guide or twist band when the projectile is fired from a drawn barrel.

6. Practice cartridge round as in claim 5, wherein at least one of the circumferential engagement slots of the central body are positioned directly above or below the guide or twist band to lock the heed projectile tip or the cartridge shell, respectively.

7. Practice cartridge round as in claim 1, wherein marking material is provided within the projectile tip in order to mark the strike point of the projectile on the target.

8. Practice cartridge round as in claim 7, wherein the marking material is at least one of a dye powder and a chemoluminescent component.

* * * * *